United States Patent [19]

Mourao et al.

[11] Patent Number: 4,778,480

[45] Date of Patent: Oct. 18, 1988

[54] COLOR STABILIZATION ADDITIVES FOR DIESEL FUEL CONTAINING RARE EARTH METALS AND OXYGENATED COMPOUNDS

[75] Inventors: Antonio M. Mourao; Rodney L. Sung, both of Fishkill, N.Y.

[73] Assignee: Texaco Inc., White Plains, N.Y.

[21] Appl. No.: 915,845

[22] Filed: Oct. 3, 1986

[51] Int. Cl.[4] ..... C10L 1/18; C10L 1/30

[52] U.S. Cl. ..... 44/57; 44/76; 44/77

[58] Field of Search ..... 44/57, 76, 77

[56] References Cited

U.S. PATENT DOCUMENTS

| | | | |
|---|---|---|---|
| 3,259,579 | 7/1966 | Rogers et al. | 44/76 |
| 3,481,716 | 12/1969 | Mrstik et al. | 44/76 |
| 3,637,586 | 1/1972 | Meitsner | 44/76 |
| 3,704,167 | 11/1972 | Schlicht et al. | 44/76 |
| 3,755,250 | 8/1973 | Wollensak et al. | 44/76 |
| 3,919,095 | 11/1975 | Okevedudu | 44/76 |
| 4,246,125 | 1/1981 | Papay et al. | 44/76 |
| 4,522,631 | 6/1985 | Mourao et al. | 44/56 |
| 4,623,363 | 11/1986 | Zaweski et al. | 44/76 |

*Primary Examiner*—Jacqueline V. Howard

*Attorney, Agent, or Firm*—Robert A. Kulason; James J. O'Loughlin; Vincent A. Mallare

[57] ABSTRACT

Diesel oil of improved color stability contains a phosphosulfurized polyisobutylene which is hydrolyzed and ethoxylated; a rare earth metal; and an oxygenated compound.

8 Claims, No Drawings

COLOR STABILIZATION ADDITIVES FOR DIESEL FUEL CONTAINING RARE EARTH METALS AND OXYGENATED COMPOUNDS

FIELD OF INVENTION

This invention relates to middle distillate fuel oils. More particularly, it is related to middle distillate fuel oils characterized by color stabilization.

BACKGROUND OF INVENTION

This invention relates to a process of color stabilization of a diesel fuel containing rare earth metals and oxygenated compounds which effectively reduce exhaust emissions of diesel fueled internal combustion engines and, more particularly, to the use of rare earth metal compounds to reduce the amount of particulates in diesel engine exhaust emissions.

Diesel fueled internal combustion engines give off particulates in the exhaust which may be harmful pollutants. These particulates are both particles seen as visible smoke and also are those particles which are invisible but still present in the diesel exhaust. The Federal Environmental Protection Agency has recently determined that diesel powered automobiles emit unacceptably high levels of air pollution and the levels of particulate emissions must be reduced to about 0.2 gram per mile by 1985. Presently most diesel engines used in automobiles will probably exceed this limit.

DISCLOSURE STATEMENT

1. U.S. Pat. Nos. 2,926,454; 3,410,670; 3,413,102; 3,539,312 and 3,449,742 all disclose various additives for use in diesel fuels to reduce particulate emissions. These patents show smoke suppressants which are commonly employed in or added to diesel fuel oils. In general, the previously most common smoke suppressants employed in a diesel fuel was an organic compound of barium. Calcium compounds have also been proposed to replace the barium materials previously suggested because of the possibility of the toxicity of the barium.

2. U.S. Pat. No. 4,207,078 discloses a reduction in soot and visible particulate matters from the exhaust of diesel fueled engines by incorporating, within the diesel fuel, an additive consisting of a mixture of an oxygenated compound and an alkyl cyclopentadienyl manganese tricarbonyl.

3. U.S. Pat. No. 4,222,746 discloses the addition of wax oxidates to diesel fuel along with a fuel soluble organometallic compound such as alkyl cyclopentadienyl manganese tricarbonyl complex salts. The combined effect of these two additives reduces the soot and visible particulates emitted from the exhaust of diesel fueled internal combustion engines.

4. U.S. Pat. No. 4,522,631 discloses diesel fuels containing rare earth metals such as cerium octoate and oxygenated compounds such as n-hexyl carbital. However, these fuels are highly unstable upon standing and turn into a deep red, almost black, color which would appear to the consumer to be decomposed. It is a common belief to the general public that dark coloration of a diesel fuel oil is an indication of oil decomposition resulting in malfunctioning in the internal combustion engine.

Thus, the primary object of the instant invention is to stabilize the aforementioned diesel fuel oils.

SUMMARY OF INVENTION

It has now been found that the addition to a diesel fuel of a soluble compound of a rare earth metal, preferably cerium, and an oxygenated compound, reduces the grams per mile of particulates produced by a diesel engine using this fuel, as defined by the EPA, to a much larger degree than the reduction in particulates which occurs by the addition of an equal amount of either of the two additives alone. The synergistic effect of the two additives dramatically reduces particulate emissions in diesel fueled internal combustion engines.

It has also been found that the diesel fuel containing rare earth metal and oxygenated compounds can be color stabilized by the addition of phosphosulfurized polyisobutylene (M.wt 1290) which is acid hydrolyzed and followed by ethoxylation to produce mono ($\beta$-hydroxyethyl) alkene thiophosphonate.

PREFERRED EMBODIMENTS OF THE INVENTION

In accordance with the invention, a diesel fuel is modified by mixing therewith an oxygenated compound and a diesel fuel soluble compound of a rare earth metal, preferably cerium. The rare earth metals that may be used include lanthanum, cerium, praseodymium, neodymium, promethium, samarium, europium, gadolinium, terbium, dysprosium, holmium, erbium, thulium, ytterbium and lutecium. Suitable oxygenated compounds include alkyl carbitols having from about 5 to about 16 carbon atoms such as n-hexylcarbitol, aldehydes and ketones having from about 3 to 16 carbon atoms such as propionaldehyde, acetone, normal alcohols having from about 3 to 16 carbon atoms, and various cyclic and normal ethers having from about 2 to about 16 carbon atoms. In general, enough of the oxygenated compound should be added to the diesel fuel to provide from about 0.0025 to about 1.5 wt. % and, preferably, from about 0.0025 to about 1 wt. % of the oxygen in the diesel fuel. Presently, the preferred oxygenated compound is a carbitol and the most preferred carbitol is n-hexylcarbitol.

The rare earth metal compound is preferably an oxygen contaning diesel fuel soluble form of the rare earth metals. The metal compound may contain from about 3 to 25 carbon atoms, even though larger numbers of carbon atoms are also useful. The preferred rare earth compounds are organometallic compounds containing oxygen. The quantity of the rare earth metal present in the diesel fuel can vary from about 0.001 to about 0.10 wt. % of the diesel fuel. Preferably, the quantity of the rare earth metal varies from about 0.001 to about 0.05 wt. % of rare earth metal in the diesel fuel. The presently most preferred form of the diesel fuel soluble rare earth metal comprises a carbonyl. Suitable rare earth metal carbonyls include rare earth metal salts of alkyl carboxylic acids and of cycloalkyl carboxylic acids. A preferred rare earth metal additive comprises a rear earth octoate which has the following formula:

$$C_7H_{15}-\overset{\overset{\displaystyle O}{\|}}{C}-O-M$$

where M stands for the rare earth metal. Presently, the most preferred rare earth metal is cerium and thus the most preferred rare earth compound is cerium octoate.

The invention also comprises a color stabilizing additive which can be represented by the formula

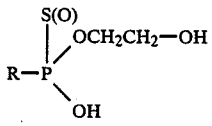

where R is an alkenyl radical of a molecular weight varying from about 1,000 to about 2,000, more preferably from about 1,000 to about 1,500, and most preferably about 1,290. It is prepared as follows:

The ethoxylated derivative of an inorganic phosphorus acid-free, steam hydrolyzed polyalkene $P_2S_5$ reaction product is prepared by first reacting a polyalkene (e.g., polybutene) of the molecular weight of between about 800 to about 2,500, wherein the reaction mixtures constitute between about 5 and to about 40 wt. %. of $P_2S_5$ in a nonoxidizing atmosphere, e.g., nitrogen, followed by hydrolyzing the resultant product by contacting it with steam at a temperature between about 100° and about 260° C. The steam treatment of the $P_2S_5$-polyalkene reaction product results in hydrolysis to form inorganic phosphorus acids in addition to the hydrolyzed organic product.

The inorganic phosphorus acids are removed from the hydrolyzed product prior to reaction with alkylene oxide by a standard procedure such as those disclosed in U.S. Pat. Nos. 2,951,835 and 2,987,512, wherein removal is effected by contact with synthetic hydrous alkaline earth metal silicates and synthetic hydrous alkali metal silicates respectively. Inorganic phosphorus acids also can be removed by extraction with anhydrous methanol, disclosed in U.S. Pat. No. 3,135,729. The steam hydrolyzed organic phosphorus acid product is then contacted with ethylene oxide at a temperature between about 60° and 145° C., under a pressure ranging from about 0 to 50 psig, utilizing a mole ratio of ethylene oxide to hydrolyzed hydrocarbon $P_2S_5$ reaction product of between about 1:1 and 4:1, preferably about 1.1:1 and 1.5:1. Excess ethylene oxide is removed from completion of the reaction by blowing the reaction mixture at an elevated temperature, generally with an inert gas such as nitrogen.

The mono ($\beta$-hydroxyethyl) alkene thiophosphonate is added at about 0.00038 wt. % to about 0.038 wt. %.

The invention also comprises a fuel additive concentrate which includes a minor amount of a diesel fuel soluble form of a rare earth metal, preferably cerium, diesel soluble oxygenated compound and a major amount of a diesel fuel composition boiling in the range of about 350° F. (175° C.) to about 750° F. (400° C.). This fuel concentrate can be added to a diesel fuel composition boiling in the range of about 350° F. (175° C.) to about 740° F. (400° C.) to reduce the particulate emission properties of the diesel fuel. Preferably, the fuel concentrate contains from about 1 wt. % to about 50 wt. % of the rare earth metal compound, whose composition is given in the previous paragraphs. Further, the fuel concentrate preferably contains from about 10.0 wt. % to about 80.0 wt. % of the oxygenated compound whose composition is given above. Preferably, the phosphosulfurized fuel concentrate contains from about 3.0 wt. % to about 39.0 wt. % of polyisobutylene.

The cerium octoate and n-hexylcarbitol additives package changes the color of diesel fuels stored at 85° F. from amber to dark red.

According to the present invention, a phosphosulfurized polyisobutylene, which is hydrolyzed and ethoxylated, is used to improve the color stability of the test fuel mixture in a long-term storage. The results are shown below in Table I.

TABLE I

STORAGE RESULTS (8-weeks @ 85° F.)

| Fuel | Appearance |
|---|---|
| Base Fuel | Yellow-Orange |
| Base Fuel + 210 ppm cerium octoate + 200 ppm N—hexylcarbitol | Dark Red |
| Base Fuel + 210 ppm cerium octoate + 200 ppm N—hexylcarbitol + 20 PTB Instant Invention | Light Red |

The test procedure, reagents and apparatus for treating a dark colored fuel are described below.

METHOD OF TEST FOR 85° F. STORAGE TEST FOR MIDDLE DISTILLATE FUELS

Outline of Method

The fuel sample is stored in a vented quart bottle, with light excluded, at a temperature of 85° F. The samples are analyzed every 7 days and the appearance is recorded.

Apparatus

A. Oven—capable of maintaining a temperature of 85+1° F.

B. Bottle—of clear, soft glass, one quart size, narrow mouth and fitted with a No.9 cork.

C. Capillary Glass Tubing—2 mm I.D. tubing, 3 inches in length and bent in the shape of the numeral 7.

Reagents

A. N-Heptane, regular grade

Procedure

A. Filter 500 ml of the fuel to be tested into the one-quart narrow-mouth bottle through a 15 cm No. 1 Whatman filter paper. Insert a piece of 2 mm I.D. glass capillary tubing (bent approximately in the shape of the numeral 7) through the cork into the one-quart bottle. This bottle shall have been previously cleaned with chromic acid cleaning solution, rinsed three times with distilled water, rinsed with acetone and air-dried. Place the bottle in an oven, preheated to 85° F.

B. Every 7 days, remove the bottle from the oven and record its appearance (color, sediment).

We claim:

1. A middle distillate fuel oil composition characterized by improved color stability which comprises a major portion of a middle distillate fuel oil; and an effective fuel color stabilizing and particulate reducing portion of an additive prepared by reacting (i) an acid hydrolyzed and ethoxylated phosphosulfurized polyisobutene, (ii) a rare earth metal compound, and (iii) an alkyl carbitol.

2. The fuel oil composition of claim 1, wherein said phosphosulfurized polyisobutene is hydrolyzed and ethoxylated of a molecular weight of about 1000 to about 2000.

3. The fuel oil composition of claim 1, wherein said phosphosulfurized polyisobutylene is hydrolyzed and ethoxylated to produce mono (β-hydroxyethyl) alkene thiophosphonate.

4. The fuel oil composition of claim 1, wherein said rare metal compound is cerium octoate.

5. The fuel oil composition of claim 1, wherein said carbitol is n-hexylcarbitol.

6. The fuel composition of claim 1 wherein said hydrolyzed and exthoxylated phosphosulfurized polyisobutylene is present in an amount of about 20 PTB of said fuel, said rare earth metal compound is present in an amount of about 52.5 PTB of said fuel and said alkyl carbitol is present in an amount of about 50 PTB of said fuel.

7. The fuel oil composition of claim 6 wherein said hydrolyzed and ethoxylated phosphosulfurized polyisobutylene is mono (β-hydroxyethyl) alkene thiphosphonate, said cerium carbonyl is cerium octoate and said alkyl carbitol is n-hexyl carbitol.

8. A fuel additive concentrate comprising:

(a) a minor amount of phospho-sulfurized polyisolentylene which is hydrolyzed and ethoxylated but a molecular weight of about 1290 and contains:
   (1) a cerium salt of an acid selected from the group consisting of carboxylic acids and cycloalkyl carboxylic acids having from about 3 to about 25 carbon atoms, and
   (2) an alkyl carbitol having from about 5 to about 16 carbon atoms; and (b) a major amount of a diesel fuel composition boiling in the range of from about 360° F. to about 750° F.

* * * * *